US011493247B2

(12) United States Patent
Sun

(10) Patent No.: US 11,493,247 B2
(45) Date of Patent: Nov. 8, 2022

(54) COOLING SYSTEM WITH ADDITIONAL RECEIVER

(71) Applicant: Heatcraft Refrigeration Products LLC, Stone Mountain, GA (US)

(72) Inventor: Xi Sun, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 247 days.

(21) Appl. No.: 16/735,234

(22) Filed: Jan. 6, 2020

(65) Prior Publication Data

US 2020/0363109 A1 Nov. 19, 2020

Related U.S. Application Data

(60) Provisional application No. 62/846,853, filed on May 13, 2019.

(51) Int. Cl.

| | |
|---|---|
| ***F25B 43/00*** | (2006.01) |
| ***F25B 49/02*** | (2006.01) |
| ***F25B 41/20*** | (2021.01) |
| ***F25B 41/24*** | (2021.01) |

(52) U.S. Cl.

CPC ..... *F25B 43/006* (2013.01); *F25B 41/20* (2021.01); *F25B 41/24* (2021.01); *F25B 49/02* (2013.01); *F25B 2400/0415* (2013.01); *F25B 2400/161* (2013.01); *F25B 2600/2523* (2013.01); *F25B 2700/04* (2013.01)

(58) Field of Classification Search

CPC ..... F25B 43/006; F25B 49/02; F25B 2400/0415; F25B 2400/161; F25B 2600/2523; F25B 2700/04; F25B 41/20; F25B 2400/13; F25B 2600/2509; F25B 2600/2515

See application file for complete search history.

(56) References Cited

U.S. PATENT DOCUMENTS 2,966,043 A 12/1960 Ross
3,145,545 A * 8/1964 Jaeger ..... B60H 1/00007 62/323.4
2015/0013363 A1* 1/2015 Arai ..... F25B 49/027 62/175

FOREIGN PATENT DOCUMENTS

EP 2718642 A1 4/2014
EP 2818808 A1 12/2014
(Continued)

OTHER PUBLICATIONS

Gritto, Multi-Evaporator Refrigeration Circuit, Dec. 13, 2012, WO2012/168544A1), Whole Document (Year: 2012).*
(Continued)

*Primary Examiner* — Larry L Furdge
(74) *Attorney, Agent, or Firm* — Baker Botts L.L.P.

(57) ABSTRACT

A cooling system includes a second receiver that receives refrigerant from a low side heat exchanger. A pipe connects the second receiver to a first receiver. A vapor portion of the refrigerant in the first receiver can flow through the pipe to the second receiver. A compressor is used to create a pressure differential in the second receiver relative to the first receiver such that the pressure in the first receiver is greater than the pressure in the second receiver. This pressure differential effectively acts as a pump that pushes the liquid refrigerant in the first receiver towards the low side heat exchanger.

20 Claims, 4 Drawing Sheets

(56) References Cited

FOREIGN PATENT DOCUMENTS

| | | | |
|---|---|---|---|
| EP | 3372919 | A1 | 9/2018 |
| JP | 2011247504 | A | 12/2011 |

OTHER PUBLICATIONS

European Patent Office, Extended European Search Report, Application No. 20155019.1, dated Aug. 12, 2020, 6 pages.

* cited by examiner

COOLING SYSTEM WITH ADDITIONAL RECEIVER

RELATED APPLICATIONS AND CLAIM TO PRIORITY

This application claims priority to U.S. Provisional Application No. 62/846,853 filed May 13, 2019 and titled "COOLING SYSTEM," which is incorporated herein by reference.

TECHNICAL FIELD

This disclosure relates generally to a cooling system.

BACKGROUND

Cooling systems are used to cool spaces, such as residential dwellings and/or commercial buildings. These systems cycle a refrigerant (also referred to as charge) that is used to cool the spaces.

SUMMARY

In many air condition systems, a pump is used to push refrigerant from a receiver to a low side heat exchanger that uses the refrigerant to cool a space. The pump, however, may be expensive. To reduce cost, certain air conditioning systems are designed to use gravity to direct the refrigerant to the low side heat exchanger instead of a pump. In these systems, the receiver that stores the refrigerant is positioned vertically above the low side heat exchanger. A long pipe (sometimes greater than 1.8 meters in length) connects the receiver to the low side heat exchanger. Gravity then pulls refrigerant from the receiver downwards towards the low side heat exchanger.

Although these pumpless systems are cheaper to produce, they are typically less efficient than systems that use pumps, because the refrigerant has very little energy when the refrigerant arrives at the low side heat exchanger. Additionally, these pumpless systems also have a large footprint and often do not fit within standard machine rooms or machine closets due to the height of the system, which includes the height of the low side heat exchanger, the long pipe, and the receiver.

This disclosure contemplates an unconventional pumpless system that addresses certain issues with conventional pumpless systems. The unconventional design includes a second receiver that receives refrigerant from the low side heat exchanger. A pipe connects the second receiver to the first receiver. A vapor portion of the refrigerant in the first receiver can flow through the pipe to the second receiver. A compressor is used to create a pressure differential in the second receiver relative to the first receiver such that the pressure in the first receiver is greater than the pressure in the second receiver. This pressure differential effectively acts as a pump that pushes the liquid refrigerant in the first receiver towards the low side heat exchanger. As a result, the refrigerant has more energy when the refrigerant arrives at the low side heat exchanger and there is no need for a long pipe to be installed between the first receiver and the low side heat exchanger. Certain embodiments are described below.

According to an embodiment, an apparatus includes a high side heat exchanger, a first receiver, a low side heat exchanger, a second receiver, a compressor, a first valve, and a second valve. The high side heat exchanger removes heat from a refrigerant. The first receiver stores the refrigerant from the high side heat exchanger. The refrigerant in the first receiver includes a first liquid portion and a first vapor portion. The low side heat exchanger uses the first liquid portion of the refrigerant from the first receiver to cool a space proximate the low side heat exchanger. The second receiver receives the refrigerant from the low side heat exchanger and separates the refrigerant from the low side heat exchanger into a second liquid portion and a second vapor portion. The compressor compresses the second vapor portion of the refrigerant from the second receiver. The first valve controls a flow of the first vapor portion from the first receiver to the second receiver. The second valve controls a flow of the second liquid portion from the second receiver to the first receiver.

According to another embodiment, a method includes removing, by a high side heat exchanger, heat from a refrigerant and storing, by a first receiver, the refrigerant from the high side heat exchanger. The refrigerant in the first receiver includes a first liquid portion and a first vapor portion. The method also includes using, by a low side heat exchanger, the first liquid portion of the refrigerant from the first receiver to cool a space proximate the low side heat exchanger and receiving, by a second receiver, the refrigerant from the low side heat exchanger. The method further includes separating, by the second receiver, the refrigerant from the low side heat exchanger into a second liquid portion and a second vapor portion and compressing, by a compressor, the second vapor portion of the refrigerant from the second receiver. The method also includes controlling, by a first valve, a flow of the first vapor portion from the first receiver to the second receiver and controlling, by a second valve, a flow of the second liquid portion from the second receiver to the first receiver.

According to yet another embodiment, a system includes a first receiver, a low side heat exchanger, a second receiver, a first valve, and a second valve. The first receiver stores a refrigerant. The refrigerant in the first receiver includes a first liquid portion and a first vapor portion. The low side heat exchanger uses the first liquid portion of the refrigerant from the first receiver to cool a space proximate the low side heat exchanger. The second receiver receives the refrigerant from the low side heat exchanger and separates the refrigerant from the low side heat exchanger into a second liquid portion and a second vapor portion. The first valve controls a flow of the first vapor portion from the first receiver to the second receiver. The second valve controls a flow of the second liquid portion from the second receiver to the first receiver.

Certain embodiments provide one or more technical advantages. For example, an embodiment improves the efficiency of an air conditioning system by increasing the energy of the refrigerant at a low side heat exchanger. As another example, an embodiment reduces the footprint of the air conditioning system by removing a need for there to be a long pipe between a receiver and a low side heat exchanger. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1A through 3 of the drawings, like numerals being used for like and corresponding parts of the various drawings.

In many air condition systems, a pump is used to push refrigerant from a receiver to a low side heat exchanger that uses the refrigerant to cool a space. The pump, however, may be expensive. To reduce cost, certain air conditioning systems are designed to use gravity to direct the refrigerant to the low side heat exchanger instead of a pump. In these systems, the receiver that stores the refrigerant is positioned vertically above the low side heat exchanger. A long pipe (sometimes greater than 1.8 meters in length) connects the receiver to the low side heat exchanger. Gravity then pulls refrigerant from the receiver downwards towards the low side heat exchanger.

Although these pumpless systems are cheaper to produce, they are typically less efficient than systems that use pumps, because the refrigerant has very little energy when the refrigerant arrives at the low side heat exchanger. Additionally, these pumpless systems also have a large footprint and often do not fit within standard machine rooms or machine closets due to the height of the system, which includes the height of the low side heat exchanger, the long pipe, and the receiver.

This disclosure contemplates an unconventional pumpless system that addresses certain issues with conventional pumpless systems. The unconventional design includes a second receiver that receives refrigerant from the low side heat exchanger. A pipe connects the second receiver to the first receiver. A vapor portion of the refrigerant in the first receiver can flow through the pipe to the second receiver. A compressor is used to create a pressure differential in the second receiver relative to the first receiver such that the pressure in the first receiver is greater than the pressure in the second receiver. This pressure differential effectively acts as a pump that pushes the liquid refrigerant in the first receiver towards the low side heat exchanger. As a result, the refrigerant has more energy when the refrigerant arrives at the low side heat exchanger and there is no need for a long pipe to be installed between the first receiver and the low side heat exchanger.

Figure 1A:
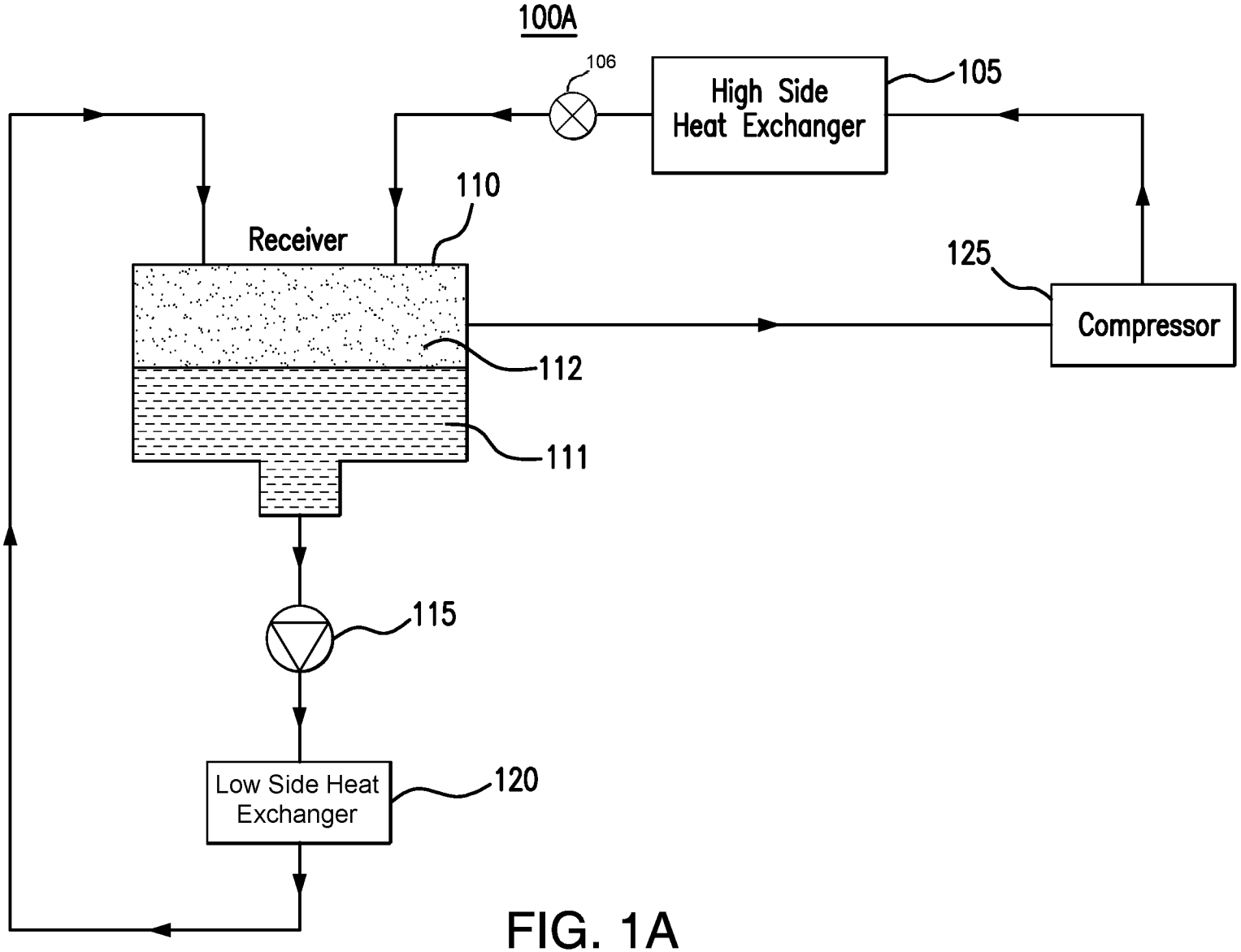
FIG. 1A illustrates an example cooling system.
Figure 1B:
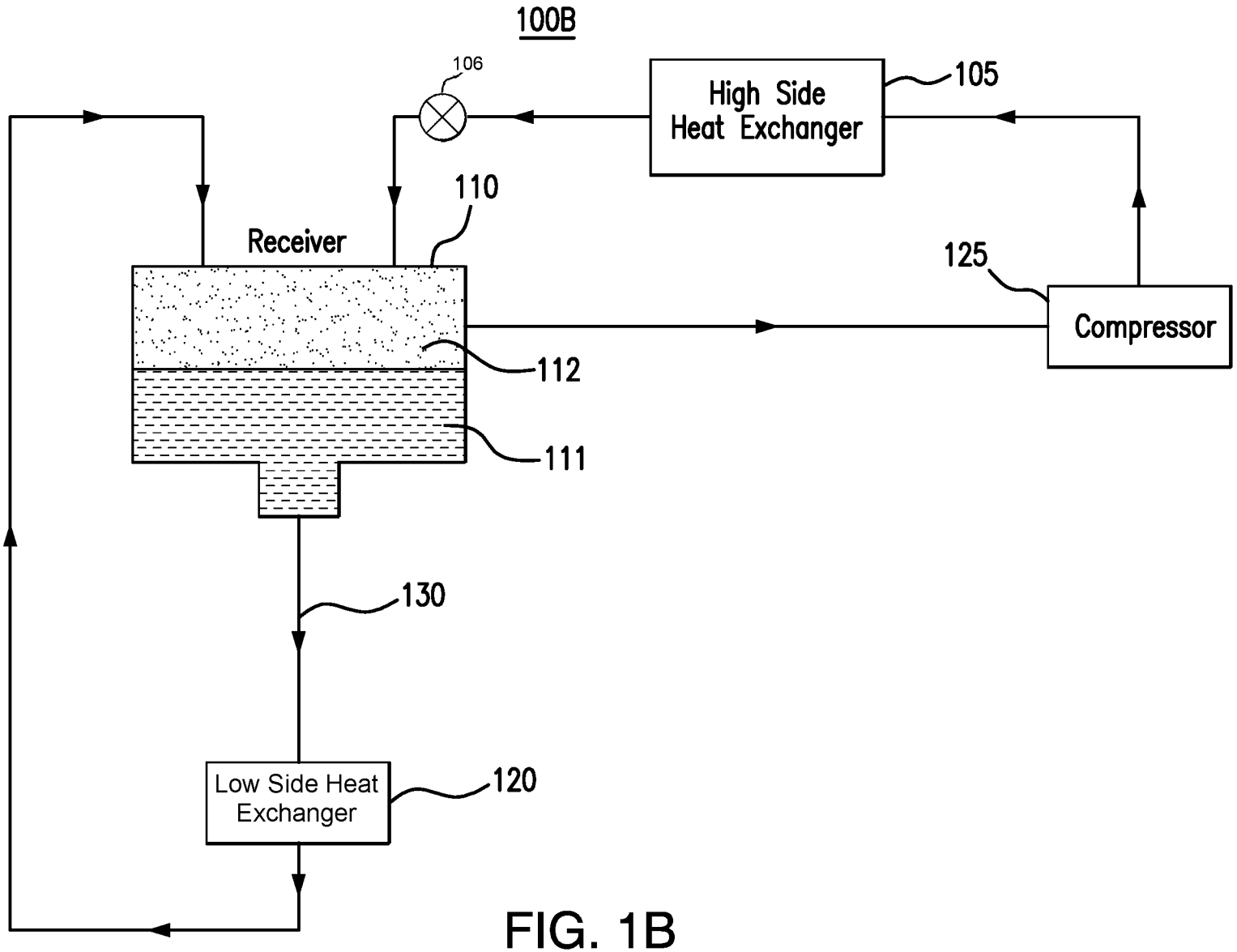
FIG. 1B illustrates an example cooling system.
Figure 2:
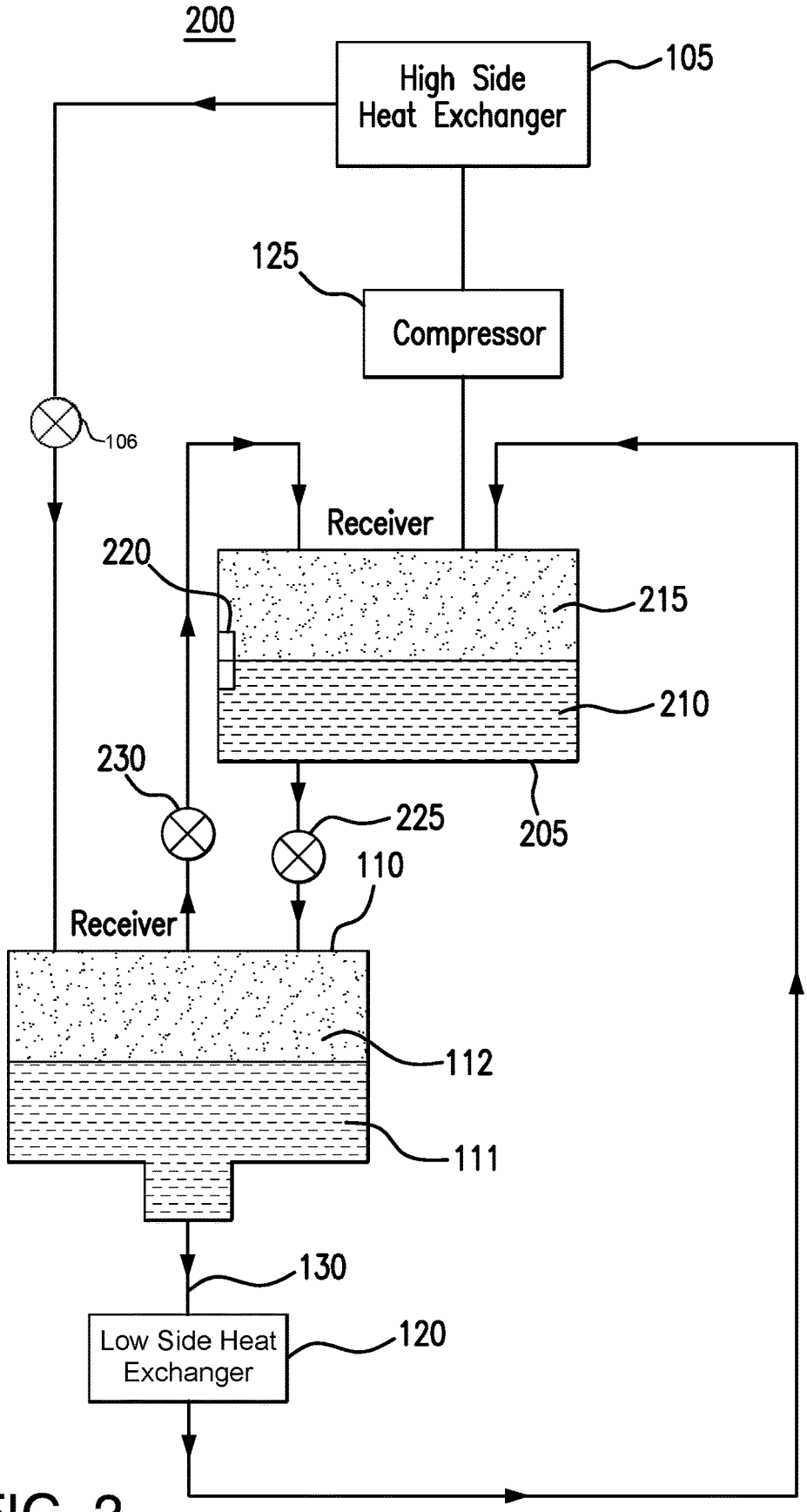
FIG. 2 illustrates an example cooling system.
Figure 3:
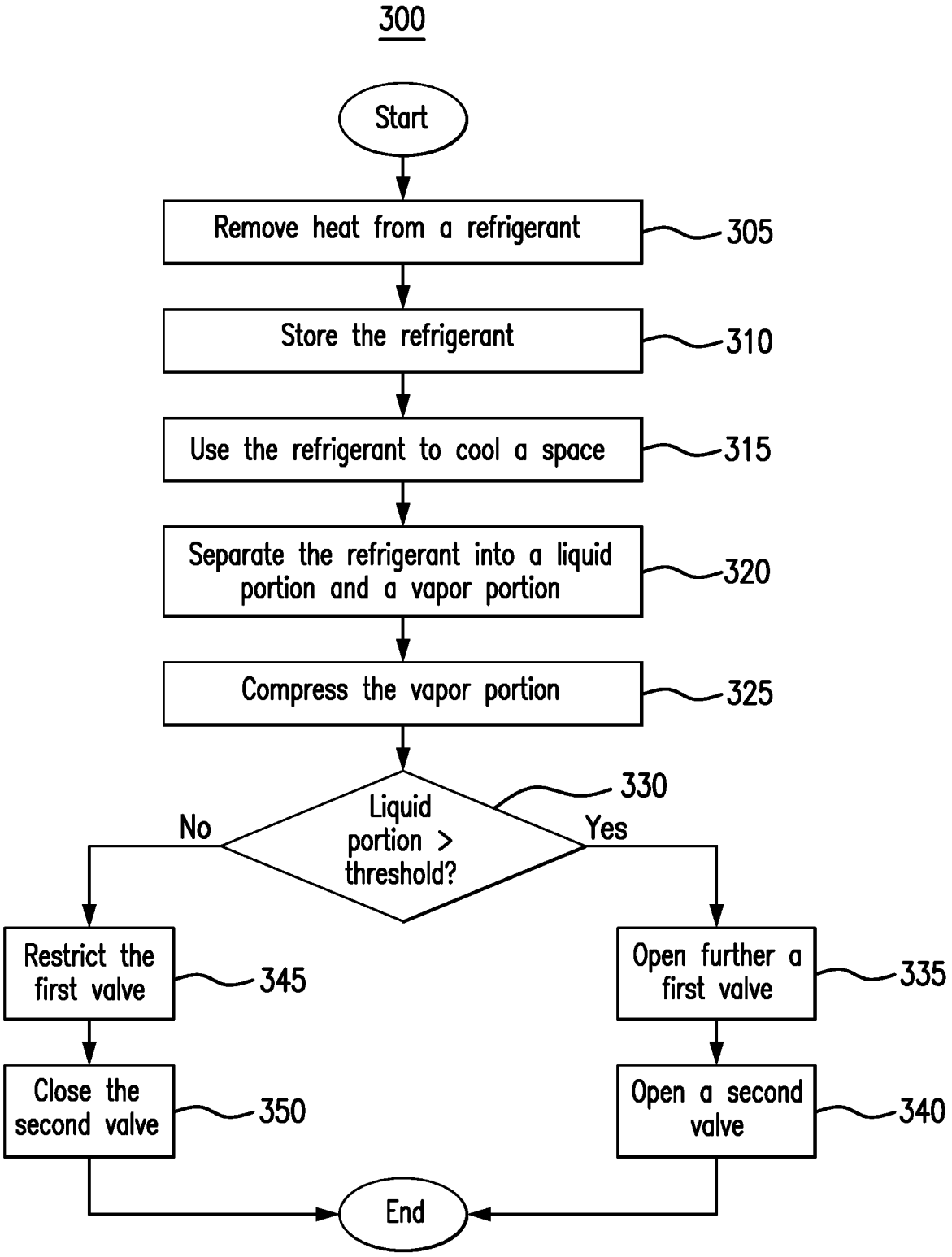
FIG. 3 is a flowchart illustrating a method of operating an example cooling system.

In certain embodiments, the system improves the efficiency of an air conditioning system by increasing the energy of the refrigerant at a low side heat exchanger. In some embodiments, the footprint of the air conditioning system is reduced by removing a need for there to be a long pipe between a receiver and a low side heat exchanger. The cooling system will be described using FIGS. 1 through 3. FIGS. 1A and 1B will describe existing cooling systems. FIGS. 2 and 3 describe the cooling system with the unconventional design.

FIG. 1A illustrates an example cooling system 100A. As shown in FIG. 1A, system 100A includes a high side heat exchanger 105, a valve 106, a receiver 110, a pump 115, a low side heat exchanger 120, and a compressor 125. Generally, refrigerant in receiver 110 is pushed to low side heat exchanger 120 by pump 115. Low side heat exchanger 120 then uses the refrigerant to cool a space proximate low side heat exchanger 120.

High side heat exchanger 105 removes heat from a refrigerant (e.g., carbon dioxide). When heat is removed from the refrigerant, the refrigerant is cooled. High side heat exchanger 105 may be operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building. Any suitable refrigerant (e.g., carbon dioxide) may be used in any of the disclosed cooling systems.

Valve 106 controls a flow of refrigerant from high side heat exchanger 105 to receiver 110. For example, when valve 106 is opened, refrigerant flows through valve 106. When valve 106 is closed, refrigerant stops flowing through valve 106. In certain embodiments, valve 106 can be opened to varying degrees to adjust the amount of flow of refrigerant. For example, valve 106 may be opened more to increase the flow of refrigerant. As another example, valve 106 may be opened less to decrease the flow of refrigerant. In this manner, valve 106 directs refrigerant from high side heat exchanger 105 to receiver 110.

Valve 106 may be an expansion valve that is used to cool refrigerant flowing through valve 106. For example, valve 106 may reduce the pressure and therefore the temperature of the refrigerant flowing through valve 106. Valve 106 reduces pressure from the refrigerant flowing into the expansion valve 106. The temperature of the refrigerant may then drop as pressure is reduced. As a result, refrigerant entering valve 106 may be cooler when leaving valve 106.

Receiver 110 stores refrigerant received from high side heat exchanger 105. Receiver 110 may store refrigerant in any state such as, for example, a liquid state and/or a vapor state. Refrigerant leaving receiver 110 is fed to low side heat exchanger 120. In some embodiments, a flash gas and/or a vapor refrigerant is released from receiver 110 to compressor 125. By releasing flash gas and/or vapor refrigerant, the pressure within receiver 110 may be reduced.

Receiver 110 may store refrigerant in both a liquid and a vapor form. For example, refrigerant entering receiver 110 may include both a liquid component and a vapor component. In some instances, the refrigerant entering receiver 110 may include only a liquid component, but as the refrigerant is stored in receiver 110, some of the liquid refrigerant evaporates and becomes a vapor in receiver 110. Receiver 110 discharges the vapor portion of the refrigerant in receiver 110 to heat exchanger 110. In this manner, the internal pressure of receiver 110 can be controlled. Receiver 110 separates the refrigerant into a liquid portion 111 and a vapor portion 112. In some embodiments, receiver 110 uses gravity to separate the liquid portion 111 from the vapor portion 112. For example, gravity may pull the liquid portion 111 down towards the bottom of the receiver 110, while the vapor portion 112 flows upwards in the receiver 110.

Pump 115 pushes the liquid portion 111 of the refrigerant in receiver 110 towards low side heat exchanger 120. The pump 115 generates a pressure differential that causes the liquid portion 111 to be pushed towards low side heat exchanger 120. In this manner, pump 115 imparts energy to a liquid portion 111 of the refrigerant in receiver 110 as it travels towards low side heat exchanger 120.

Low side heat exchanger 120 uses refrigerant from receiver 110 to cool a space proximate low side heat exchanger 120. For example, low side heat exchanger 120 may send refrigerant through metallic coils that are cooled by the refrigerant. The coils then cool the air around the coils. A blower or fan may then circulate the cool air throughout a space to cool the space. Low side heat exchanger 120 may include any components that cool a space using refrigerant. For example, low side heat exchanger 120 may include a heat exchanger that transfers heat from one solution to the refrigerant. The solution is then cooled and may be used to cool a space. As another example, low side heat exchanger 120 may include plates or fins that are cooled by the refrigerant. Low side heat exchanger 120 may include any components that use refrigerant to cool a space. Low side heat exchanger 120 directs refrigerant to receiver 110. Low side heat exchanger 120 may not evaporate all of the liquid refrigerant that is directed to low side heat exchanger 120. As a result, the refrigerant that low side heat exchanger 120 sends back to receiver 110 may include a liquid portion and a vapor portion. As discussed above, the liquid portion may then be directed to low side heat exchanger 120 and the vapor portion may then be directed to compressor 125.

Compressor 125 compresses refrigerant to increase the pressure of the refrigerant. As a result, the heat in the refrigerant may become concentrated and the refrigerant may become a high-pressure gas. Compressor 125 compresses refrigerant from receiver 110 and sends the compressed refrigerant to high side heat exchanger 105.

In many instances pump 115 may be an expensive component in system 100A. As a result, the cost of system 100A may make system 100A undesirable. To reduce cost, certain designs and installations do not include pump 115. Such a system is shown in FIG. 1B.

FIG. 1B shows an example cooling system 100B. As shown in FIG. 1B, system 100B includes high side heat exchanger 105, valve 106, receiver 110, low side heat exchanger 120, compressor 125, and pipe 130. Generally, high side heat exchanger 105, receiver 110, low side heat exchanger 120, and compressor 125 operate similarly as they did in system 100A. For example, high side heat exchanger 105 removes heat from the refrigerant. Valve 106 controls a flow of refrigerant from high side heat exchanger 105 to receiver 110. Receiver 110 stores a refrigerant in both a liquid portion 111 and a vapor portion 112. Low side heat exchanger 120 uses refrigerant from receiver 110 to cool a space proximate low side heat exchanger 120. Compressor 125 compresses vapor portion 112 of the refrigerant in receiver 110.

An important difference between system 100B and system 100A is that system 100B does not include a pump that pushes refrigerant from receiver 110 to low side heat exchanger 120. Instead, system 100B includes a pipe 130 that couples receiver 110 to low side heat exchanger 120. Gravity pulls liquid portion 111 of refrigerant in receiver 110 through pipe 130 to low side heat exchanger 120. Low side heat exchanger 120 then uses this refrigerant to cool a space approximate low side heat exchanger 120.

Although the cost of system 100B is typically lower than the costs of system 100A, the pumpless design of system 100B introduces other issues. For example, because there is no pump to push liquid portion 111 of refrigerant towards low side heat exchanger 120, the refrigerant that reaches low side heat exchanger 120 has little energy. As a result, low side heat exchanger 120 cannot operate as efficiently. Additionally, pipe 130 is often a long pipe. For example, in some installations, pipe 130 exceeds 1.8 meters in length. As a result, system 100B may not fit within standard machine rooms or machine closets because the height of system 100B is great. In some installations, the height of system 100B includes the height of low side heat exchanger 120, the height of receiver 110, and the length of pipe 130. This height prevents system 100B from fitting in certain spaces which makes system 100B undesirable for certain applications.

An additional issue with system 100B is that any small blockage or impediment within pipe 130 significantly impacts the performance and efficiency of system 100B. Because refrigerant is being pulled only by gravity through pipe 130, any small impediment within pipe 130, such as, for example, a valve opening, significantly impacts the energy of the refrigerant arriving at low side heat exchanger 120. As a result, even small impediments, such as a 2% blockage that is caused by a valve, may reduce the efficiency of low side heat exchanger 120 significantly.

This disclosure contemplates an unconventional design of a pumpless cooling system that addresses the issues in system 100A and system 100B. This design will be described using FIGS. 2 and 3. FIG. 2 describes the structure and operation of the design. FIG. 3 describes an example operation of the design.

FIG. 2 illustrates an example cooling system 200. As seen in FIG. 2, system 200 includes a high side heat exchanger 105, a valve 106, a receiver 110, a low side heat exchanger 120, a compressor 125, a pipe 130, a receiver 205, a valve 225, and a valve 230. Generally, system 200 increases the energy of refrigerant flowing from receiver 110 to low side heat exchanger 120 by using compressor 125 to create a pressure differential between receiver 110 and receiver 205. As a result, the efficiency of low side heat exchanger 120 is improved and the size of system 200 is reduced in certain embodiments, Generally, high side heat exchanger 105, receiver 110, low side heat exchanger 120, compressor 125, and low side heat exchanger 130 operate similarly as they did in systems 100A and 100B. For example, high side heat exchanger 105 removes heat from a refrigerant. Valve 106 controls a flow of refrigerant from high side heat exchanger 105 to receiver 110. Receiver 110 stores a refrigerant in a liquid portion 111 and a vapor portion 112. Low side heat exchanger 120 uses the refrigerant from receiver 110 to cool a space proximate low side heat exchanger 120. Compressor 125 compresses a refrigerant. Pipe 130 directs a refrigerant from receiver 110 to low side heat exchanger 120.

A difference between system 200 and systems 100A and 100B is the addition of receiver 205. As seen in FIG. 2, receiver 205 stores a refrigerant in a liquid portion 210 and a vapor portion 215. Receiver 205 receives the refrigerant from low side heat exchanger 120. This refrigerant includes both a liquid portion and/or a vapor portion. Receiver 205 receives this refrigerant and separates this refrigerant into liquid portion 210 and vapor 215. Receiver 205 may use gravity to separate the liquid portion 210 from the vapor portion 215. Gravity pulls the liquid portion 210 towards the bottom of receiver 205 while vapor portion 215 rises towards the top of receiver 205. As seen in FIG. 2, receiver 205 is positioned vertically above receiver 110, and receiver 110 is positioned vertically above low side heat exchanger 120. As a result, depending on the state of valves 225 and 230, gravity may cause a flow of liquid refrigerant from receiver 205 to receiver 110 and/or from receiver 110 to low side heat exchanger 120.

Compressor 125 compresses vapor portion 215 of the refrigerant in receiver 205. Compressor 125 then directs the compressed refrigerant to high side heat exchanger 105. In this manner, the pressure within receiver 205 is reduced by compressor 125 such that the pressure within receiver 205 is approximately the suction pressure of compressor 125. Compressor 125 thus lowers the pressure of receiver 205 relative to the pressure of receiver 110. This pressure differential between the two receivers effectively creates a pump that pushes liquid portion 111 of refrigerant in receiver 110 towards low side heat exchanger 120. As a result, the energy of refrigerant arriving at low side heat exchanger 120 is increased.

System 200 operates in two different modes. During a first mode of operation, or a regular mode of operation, valve 225 is closed and valve 230 is open. In some instances, valve 230 is partially open such that vapor portion 112 of the refrigerant in receiver 110 can flow from receiver 110 through valve 230 to receiver 205 without significantly affecting the pressure differential between receiver 205 and receiver 110. Additionally, during this first mode of operation, liquid portion 111 of refrigerant in receiver 110 flows through pipe 130 to low side heat exchanger 120. Low side heat exchanger 120 uses this refrigerant to cool space proximate low side heat exchanger 120 and directs the refrigerant to receiver 205. Because valve 225 is closed, refrigerant begins accumulating in receiver 205. For example, liquid portion 210 of the refrigerant in receiver 205 begins to increase in volume.

To prevent receiver 205 from overflowing, a sensor 220 is coupled to receiver 205 to detect a level of liquid portion 210 of refrigerant in receiver 205. Sensor 220 can detect when the level of liquid portion 210 of refrigerant in receiver 205 exceeds or rises above a threshold. When the level of liquid portion 210 of refrigerant in receiver 205 exceeds or rises above the threshold, system 200 transitions to a second mode of operation to drain receiver 205.

To transition to the second mode of operation, valve 225 opens and valve 230 is opened further. In some instances, valve 230 is opened fully. When valve 230 is opened further, the pressure of receiver 110 and the pressure of receiver 205 equalize. Because valve 225 is opened and the pressures are equalized, liquid portion 210 of refrigerant in receiver 205 flows from receiver 205 down through valve 225 to receiver 110. As a result, receiver 205 is drained.

In some instances, system 200 transitions from the second mode of operation back to the first mode of operation when the level of liquid portion 210 of the refrigerant in receiver 205 falls below a certain threshold. In some instances, system 200 transitions from the second mode of operation back to the first mode of operation when receiver 205 has been drained for a certain period of time. To transition from the second mode of operation back to the first mode of operation, valve 225 is closed and valve 230 is restricted. In some instances, valve 230 closes partially. As a result, refrigerant begins accumulating again in receiver 205 and the pressure differential between receiver 110 and receiver 205 increases.

Because system 200 uses compressor 125 and receiver 205 to simulate a pump that increases the energy of the refrigerant at low side heat exchanger 120, the length of pipe 130 may be reduced without significant impact to the efficiency of system 200. For example, the length of pipe 130 may be reduced to be shorter than 1.8 meters in length, which reduces the height of system 200. This may allow system 200 to fit within standard machine rooms or machine closets.

FIG. 3 is a flowchart illustrating a method 300 of operating an example cooling system. In particular embodiments, various components of system 200 perform method 300. By performing method 300, the energy of refrigerant arriving at a low side heat exchanger is increased and the overall footprint or size of the cooling system is reduced.

In step 305, a high side heat exchanger removes heat from a refrigerant. A receiver stores the refrigerant in step 310. In step 315, a low side heat exchanger uses the refrigerant to cool a space. In step 320, a receiver separates the refrigerant from the low side heat exchanger into a liquid portion and a vapor portion. A compressor compresses the vapor portion in step 325.

In step 330, a sensor detects whether a level of the liquid portion of the refrigerant in the receiver exceeds a threshold. If the level exceeds the threshold, then a first valve is opened further in step 335 and a second valve is opened in step 340. In some instances, the first valve is fully opened in step 335.

By opening these valves, the pressure between two receivers is equalized and the liquid portion of the refrigerant flows from one receiver to another, thus draining the first receiver.

When the level of the liquid portion of the refrigerant in the receiver reduces or falls below the threshold, then the first valve is restricted in step 345 and the second valve is closed in step 350. In this manner, the liquid portion of the refrigerant is prevented from flowing to another receiver and a pressure differential is established between the two receivers.

Modifications, additions, or omissions may be made to method 300 depicted in FIG. 3. Method 300 may include more, fewer, or other steps. For example, steps may be performed in parallel or in any suitable order. While discussed as system 200 (or components thereof) performing the steps, any suitable component of system 200 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the high side heat exchanger, the refrigerant from the receiver, etc.). When such terminology is used, this disclosure is not limiting the described refrigerant to being directly from the particular component. This disclosure contemplates refrigerant being from a particular component (e.g., the high side heat exchanger, the receiver, etc.) even though there may be other intervening components between the particular component and the destination of the refrigerant. For example, the receiver receives a refrigerant from another receiver even though there may be a valve between the receivers.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a high side heat exchanger configured to remove heat from a refrigerant;

a first receiver configured to store the refrigerant from the high side heat exchanger, the refrigerant in the first receiver comprising a first liquid portion and a first vapor portion;

a low side heat exchanger configured to use the first liquid portion of the refrigerant from the first receiver to cool a space proximate the low side heat exchanger;

a second receiver configured to:

receive the refrigerant from the low side heat exchanger; and separate the refrigerant from the low side heat exchanger into a second liquid portion and a second vapor portion;

a compressor configured to compress the second vapor portion of the refrigerant from the second receiver;

a first valve controls a flow of the first vapor portion from the first receiver to the second receiver; and a second valve controls a flow of the second liquid portion from the second receiver to the first receiver;

logic implemented by hardware and configured to operate the apparatus in a first mode of operation and a second mode of operation;

wherein during the first mode of operation:

the first valve is in an open position and the first valve directs the flow of the first vapor portion from the first receiver to the second receiver;

the second valve is in a closed position and the second valve inhibits the flow of the second liquid portion from the second receiver to the first receiver; and the compressor reduces a pressure within the second receiver to create a pressure differential between the first receiver and the second receiver operable to direct the first liquid portion to the low side heat exchanger; and wherein during the second mode of operation:

the first valve is in the open position;

the second valve is in the open position and the second valve directs the flow of the second liquid portion from the second receiver to the first receiver; and the compressor reduces the pressure within the second receiver.

2. The apparatus of claim 1, further comprising a sensor coupled to the second receiver, the sensor configured to detect when a level of the second liquid portion of the refrigerant in the second receiver exceeds a threshold.

3. The apparatus of claim 2, wherein the second valve is further configured to open when the level of the second liquid portion of the refrigerant in the second receiver exceeds the threshold such that the second liquid portion of the refrigerant in the second receiver flows to the first receiver.

4. The apparatus of claim 2, wherein the first valve is further configured to open further when the level of the second liquid portion of the refrigerant in the second receiver exceeds the threshold.

5. The apparatus of claim 1, further comprising a pipe coupled to the first receiver and the low side heat exchanger, the pipe is shorter than 1.8 meters in length, the first liquid portion of the refrigerant in the first receiver flows from the first receiver through the pipe to the low side heat exchanger.

6. The apparatus of claim 1, wherein the first receiver is positioned vertically above the low side heat exchanger.

7. The apparatus of claim 1, wherein the second receiver is positioned vertically above the first receiver.

8. A method comprising:

removing, by a high side heat exchanger, heat from a refrigerant;

storing, by a first receiver, the refrigerant from the high side heat exchanger, the refrigerant in the first receiver comprising a first liquid portion and a first vapor portion;

using, by a low side heat exchanger, the first liquid portion of the refrigerant from the first receiver to cool a space proximate the low side heat exchanger;

receiving, by a second receiver, the refrigerant from the low side heat exchanger;

separating, by the second receiver, the refrigerant from the low side heat exchanger into a second liquid portion and a second vapor portion;

compressing, by a compressor, the second vapor portion of the refrigerant from the second receiver;

controlling, by a first valve, a flow of the first vapor portion from the first receiver to the second receiver; and controlling, by a second valve, a flow of the second liquid portion from the second receiver to the first receiver, during a first mode of operation:

directing, by the first valve, the flow of the first vapor portion from the first receiver to the second receiver, wherein the second valve is in a closed position inhibiting the flow of the second liquid portion from the second receiver to the first receiver; and actuating the compressor to reduce a pressure within the second receiver to create a pressure differential between the first receiver and the second receiver operable to direct the first liquid portion to the low side heat exchanger; and during a second mode of operation:

actuating the second valve to transition to the open position;

directing, by the second valve, the flow of the second liquid portion from the second receiver to the first receiver, wherein the first valve remains in the open position; and actuating the compressor to reduce the pressure within the second receiver.

9. The method of claim 8, further comprising detecting, by a sensor coupled to the second receiver, when a level of the second liquid portion of the refrigerant in the second receiver exceeds a threshold.

10. The method of claim 9, further comprising opening the second valve when the level of the second liquid portion of the refrigerant in the second receiver exceeds the threshold such that the second liquid portion of the refrigerant in the second receiver flows to the first receiver.

11. The method of claim 9, further comprising opening further the first valve when the level of the second liquid portion of the refrigerant in the second receiver exceeds the threshold.

12. The method of claim 8, wherein a pipe is coupled to the first receiver and the low side heat exchanger, the pipe is shorter than 1.8 meters in length, the first liquid portion of the refrigerant in the first receiver flows from the first receiver through the pipe to the low side heat exchanger.

13. The method of claim 8, wherein the first receiver is positioned vertically above the low side heat exchanger.

14. The method of claim 8, wherein the second receiver is positioned vertically above the first receiver.

15. A system comprising:

a first receiver configured to store a refrigerant, the refrigerant in the first receiver comprising a first liquid portion and a first vapor portion;

a low side heat exchanger configured to use the first liquid portion of the refrigerant from the first receiver to cool a space proximate the low side heat exchanger;

a second receiver configured to:

receive the refrigerant from the low side heat exchanger; and separate the refrigerant from the low side heat exchanger into a second liquid portion and a second vapor portion;

a first valve controls a flow of the first vapor portion from the first receiver to the second receiver; and a second valve controls a flow of the second liquid portion from the second receiver to the first receiver;

logic implemented by hardware and configured to operate the apparatus in a first mode of operation and a second mode of operation;

wherein during the first mode of operation:

the first valve is in an open position and the first valve directs the flow of the first vapor portion from the first receiver to the second receiver;

the second valve is in a closed position and the second valve inhibits the flow of the second liquid portion from the second receiver to the first receiver; and wherein during the second mode of operation:

the first valve is in the open position; and the second valve is in the open position and the second valve directs the flow of the second liquid portion from the second receiver to the first receiver.

16. The system of claim 15, further comprising a sensor coupled to the second receiver, the sensor configured to detect when a level of the second liquid portion of the refrigerant in the second receiver exceeds a threshold.

17. The system of claim 16, wherein the second valve is further configured to open when the level of the second liquid portion of the refrigerant in the second receiver exceeds the threshold such that the second liquid portion of the refrigerant in the second receiver flows to the first receiver.

18. The system of claim 16, wherein the first valve is further configured to open further when the level of the second liquid portion of the refrigerant in the second receiver exceeds the threshold.

19. The system of claim 15, further comprising a pipe coupled to the first receiver and the low side heat exchanger, the pipe is shorter than 1.8 meters in length, the first liquid portion of the refrigerant in the first receiver flows from the first receiver through the pipe to the low side heat exchanger.

20. The system of claim 15, wherein the second receiver is positioned vertically above the first receiver.

* * * * *